US006199219B1

(12) United States Patent
Silken et al.

(10) Patent No.: US 6,199,219 B1
(45) Date of Patent: Mar. 13, 2001

(54) DEVICE TO FACILITATE REMOVAL OF A HELMET FACE MASK

(76) Inventors: Howard Silken, 5600 Forest Oaks Ter., Delray Beach, FL (US) 33484; Joanne Silken, 1919 The Alameda, #143, San Mateo, CA (US) 94403

( * ) Notice: Subject to any disclaimer, the term of this patent is extended or adjusted under 35 U.S.C. 154(b) by 0 days.

(21) Appl. No.: 09/249,564

(22) Filed: Feb. 8, 1999

Related U.S. Application Data

(60) Provisional application No. 60/084,695, filed on May 8, 1998.

(51) Int. Cl.[7] ..... A42B 3/20
(52) U.S. Cl. ..... 2/424; 24/458
(58) Field of Search ..... 2/410, 411, 424, 2/425, 9, 10; 24/457, 458, 3.1; 248/74.3

(56) References Cited

U.S. PATENT DOCUMENTS 3,729,746 * 5/1973 Humphrey ..... 2/9
4,086,664 * 5/1978 Humphrey et al. ..... 2/9
4,633,531 * 1/1987 Nimmons ..... 2/424
4,837,866 * 6/1989 Rector et al. ..... 2/424
5,095,552 * 3/1992 Parkinson ..... 2/424

* cited by examiner

*Primary Examiner*—Michael A. Neas
(74) *Attorney, Agent, or Firm*—Scott L. Lampert

(57) ABSTRACT

A quick release device for use with a helmet having a face mask comprising at least two generally U-shaped clips having an outer leg, an opposite inner leg and a transverse slot disposed between the outer and inner legs for retaining the face mask bars therein. A coupling mechanism having a female member structured to be secured to the helmet and a generally T-shaped male member structured for mating engagement with the female member releasably secures the clips to the helmet. The female member includes a lower, partially externally threaded portion structured for insertion through a mounting hole in the helmet and mating engagement with an internally threaded locking member, an opposite upper portion structured to extend outward from the outside surface of the helmet and into a mounting hole in the clip, and an outwardly extending flange disposed between the lower and upper portions. A hole and generally J-shaped locking slot, accessible from the uppermost surface of the upper portion, are structured to receive the leg of the male member and locking pin extending outward from the lower portion of such leg, respectively, therein as the male member is depressed and rotated.

19 Claims, 3 Drawing Sheets

DEVICE TO FACILITATE REMOVAL OF A HELMET FACE MASK

This application claims the benefit of U.S. Provisional Application No. 60/084,695 filed May 8, 1998, which has not previously been patented or abandoned.

BACKGROUND OF THE INVENTION

1. Field of the Invention

The present invention relates to protective headgear and, more, particularly, to a device which facilitates the removal of a helmet face mask.

2. Description of the Related Art

The need for protective headgear in certain sporting events is well recognized. In many events, such headgear typically includes face masks. For instance, football and lacrosse players, to name just a few, generally wear helmets with face masks.

Despite the use of such protective headgear, the frequency of serious head, neck and spinal injuries has increased over the past several years. Furthermore, it is not uncommon for such injuries to be accompanied by respiratory complications or cardiac arrest. In such instances, immediate access to the player's face is vital. Thus, removal of the player's helmet or face mask will be necessary.

However, upon occurrence of such injuries, it is also vital that the player's head and neck be immobilized so that normal alignment of the cervical spine may be maintained and further injury prevented. Thus, removal of the player's helmet is usually not an option. Consequently, the attending medical personnel will usually attempt to remove the face mask attached to the helmet to provide the necessary access to the player's face.

Unfortunately, quick removal of prior art helmet face masks, while maintaining the stability of the player's head and neck, is virtually impossible due to inherent deficiencies in the design and construction of such helmets. Specifically, as shown in U.S. Pat. Nos. 4,774,729, 4,233,687, 4,363,140 and 4,390.995, face masks are typically secured to the helmets with rivets, bolts or other similar permanent fasteners. Consequently, removal of the face mask requires extraction of the rivets or bolts from the helmet, which must be done carefully and slowly in order to avoid movement of the player's head and neck during such removal.

As an alternative to removing the rivet or bolt from the helmet, the clips holding the face mask in place on the helmet may themselves be cut to remove the face mask. However, this requires the use of some sort of heavy bolt or wire cutter and the exertion of a fairly large force to cut through each clip, which is time consuming and difficult to accomplish without causing movement and further trauma to the player's head.

Over the past several years, efforts to improve the design and construction of helmets and face masks have focused predominately on means to release the face mask from the helmet upon being grabbed and twisted, so that the risk of injury to the player's head and neck may be diminished. U.S. Pat. Nos. 4,885,807, 5,502,843, 4,947,490, 4,985,938 and 4,271,537 illustrative a few of the many inventions designed for such purpose. However, these devices have not been widely accepted because they result in the face mask being removed from the player's helmet while play continues, which is generally not desirable.

Although such devices enable the face mask to be removed, their use is not practical in situations for which Applicant's invention has been developed. Specifically, if a player has sustained a neck, head or spinal injury, twisting or yanking the face mask in an effort to remove it from the helmet will most likely cause further injury to the player and, consequently, is certainly not an option. Thus, although these prior art patents permit the face mask to be quickly released from the helmet, they do so in a manner not useful to address the problem specifically identified and addressed by Applicant's invention.

The prior art fails to recognize the problem discovered by Applicant and, consequently, there is no suggestion or motivation for one of ordinary skill in the art to modify any of the prior art devices in the manner disclosed by applicant's invention or in any other manner which might address this problem. Such lack of disclosure, suggestion or teaching in the prior art supports the conclusion that part of applicant's invention is the discovery of the problem, that is, the need for a face mask capable of being quickly removed from a helmet while maintaining the helmet in a generally stationary condition.

Thus, there is still a need in the art for a face mask capable of being quickly removed from a helmet while maintaining the helmet in a generally stationary condition. Any such device should be easy to use and should be capable for use with newly manufactured helmets as well as existing helmets. The present invention is particularly suited to overcome those problems which remain in the art in a manner not previously known.

SUMMARY OF THE INVENTION

The present invention is directed towards a new and improved quick release device for use with a helmet having a face mask with at least one generally rigid bar extending across the facial opening of the helmet. The quick release device comprises at least two generally U-shaped clips, each structured to removably secure a portion of one of the face mask bars therein. Each clip includes an outer leg, an opposite inner leg, a transverse slot disposed between the outer and inner legs for retaining the face mask bars therein, and a first mounting hole extending through the outer and inner legs. A coupling mechanism having a female member structured to be secured to the helmet and a generally T-shaped male member structured for mating engagement with the female member releasably secures the clips to the helmet. The female member includes a lower, partially externally threaded portion structured for insertion through a mounting hole in the helmet and mating engagement with an internally threaded locking member, an opposite upper portion structured to extend outward from the outside surface of the helmet and through the first mounting hole in the inner leg of the clip, and an outwardly extending flange disposed between the lower and upper portions. A hole and generally J-shaped locking slot, accessible from the uppermost surface of the upper portion, are structured to receive the leg of the male member and locking pin extending outward from the lower portion of the leg, respectively, therein as the male member is depressed and rotated.

It is an object of the present invention to provide a new and improved quick release device which has all the advantages of the prior art devices and none of the disadvantages.

It is another object of the present invention to provide a quick release device for use with helmets having a face mask.

It is also an object of the present invention to provide such a device which enables a face mask to be quickly removed from the helmet while the helmet is maintained in a generally stationary position.

It is a further object of the present invention to provide such a device which includes alternative means for releasing the face mask from the helmet.

It is yet another object of the present invention to provide such a device which is capable for use with newly manufactured helmets as well as existing helmets.

These and other objects and advantages of the present invention will become more readily apparent in the description which follows.

BRIEF DESCRIPTION OF THE DRAWINGS

For a fuller understanding of the nature of the present invention, reference should be had to the following detailed description, taken in connection with the accompanying drawings in which.

Like reference numerals refer to like parts throughout the several views of the drawings.

DETAILED DESCRIPTION OF THE PREFERRED EMBODIMENT

Figure 1:
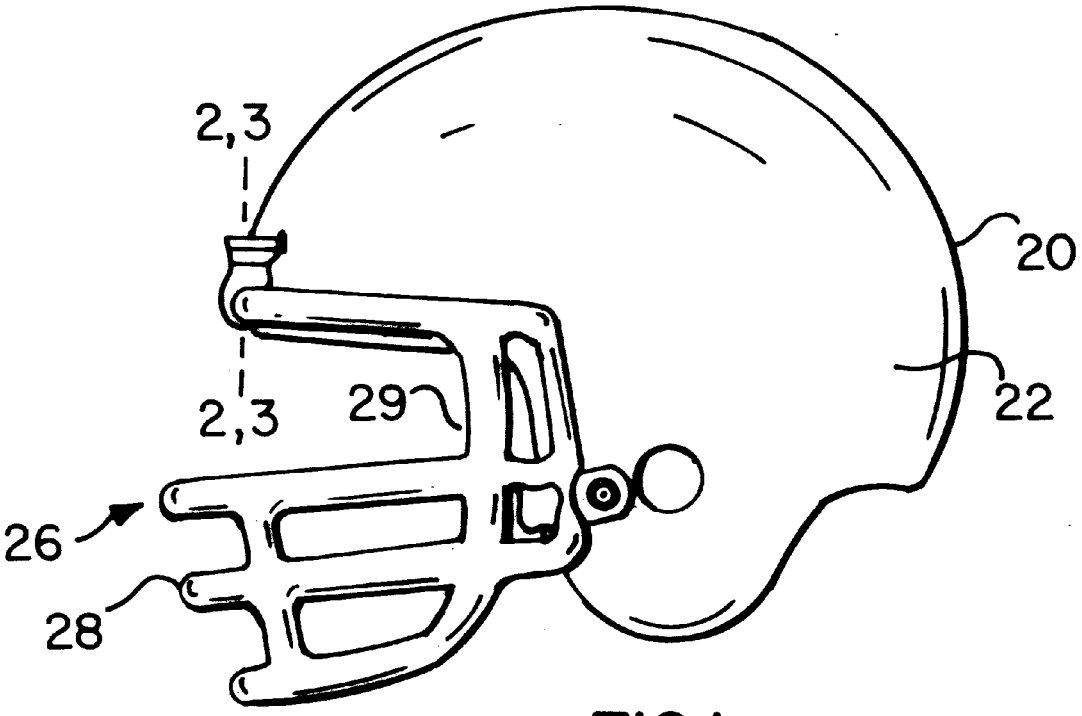
FIG. 1 is a perspective view of a helmet with the quick release device of the present invention.

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

As shown in FIGS. 1–4, the present invention is directed towards a new and improved quick release mechanism 10 for use with a helmet 20 having a face mask 26 with at least one generally rigid bar 28 extending across the facial opening 29 of the helmet 20. The helmet 20 is of the type well known in the art and used in sporting events such as football, hockey or lacrosse. Such helmets 20 are structured to be removably seated over a person's head so that the inside surface of the helmet 20 is in substantially direct contact with said person's head in generally overlying relation thereto.

In its preferred embodiment, the quick release mechanism 10 comprises at least two generally U-shaped clips 30, each structured to removably secure a portion of one of the face mask 26 bars 28 therein. Each clip 30 includes an outer leg 32, an opposite inner leg 34 and a transverse slot 35 disposed between the outer 32 and inner 34 legs for retaining the face mask 26 bars 28. The face mask 26 bars 28 are inserted into the slot 35 by pulling the outer 32 and inner 34 legs apart from one another and sliding the face mask 26 bar 28 therebetween. A first mounting hole 36 extends through the outer 32 and inner 34 legs of each clip 30 to provide a means for retaining the outer 32 and inner 34 legs together and securing the clip 30 to the outside surface 22 of the helmet 20.

A coupling mechanism 40 is provided to releasably secure the clips 30 to the helmet 20. The coupling mechanism 40 includes a female member 42 structured to be secured to the helmet 20 and a male member 60 structured for removable insertion into the first mounting hole 36 of the clip 30 and mating engagement with the female member 42. The male member 60 includes a generally T-shaped cross section and has a generally flat head 62 and a generally tubular leg 64 extending out from the head 62 in perpendicular relation thereto. A locking pin 66 extends outward from the lower portion of the leg 64 in perpendicular relation thereto. A generally longitudinally disposed recessed slot 68 is provided in the upper surface of the head 62 to accommodate a screw driver, coin or other rotation driver.

The female member 42 includes a lower, partially externally threaded portion 46, an opposite upper portion 47 and an outwardly extending flange 48 disposed between the lower 46 and upper 47 portions. The lower portion 46 is structured for insertion through a mounting hole 27 in the helmet 20 and mating engagement with an internally threaded locking member 51 disposed on the inside surface 24 of the helmet 20. The flange 48 is structured to be seated within a recessed cavity 38 in the outer face 37 of the inner leg 34 of the clip 30 around the first mounting hole 36 so that the outer face 37 of the inner leg 34 rests flush against the outside surface 22 of the helmet 20 when the clip 30 is secured to the helmet 20.

In the preferred embodiment, the lower portion 46 of the female member 42 includes a left-handed thread structured to tighten the locking member 51 upon application of a counter clockwise rotation on the male member 60. Such tightening action will reduce the possibility of the female member 42 rotating with the male member 60, which might prevent their removal from one another.

Figure 4:
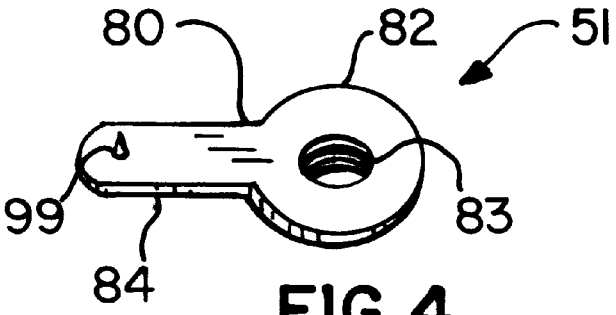
FIG. 4 is a perspective view of the wrench-shaped locking member.
Figure 5:
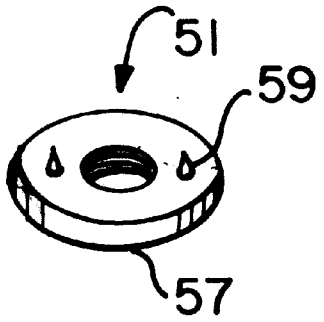
FIG. 5 is a perspective view of the nut with engagement pins.
Figure 2:
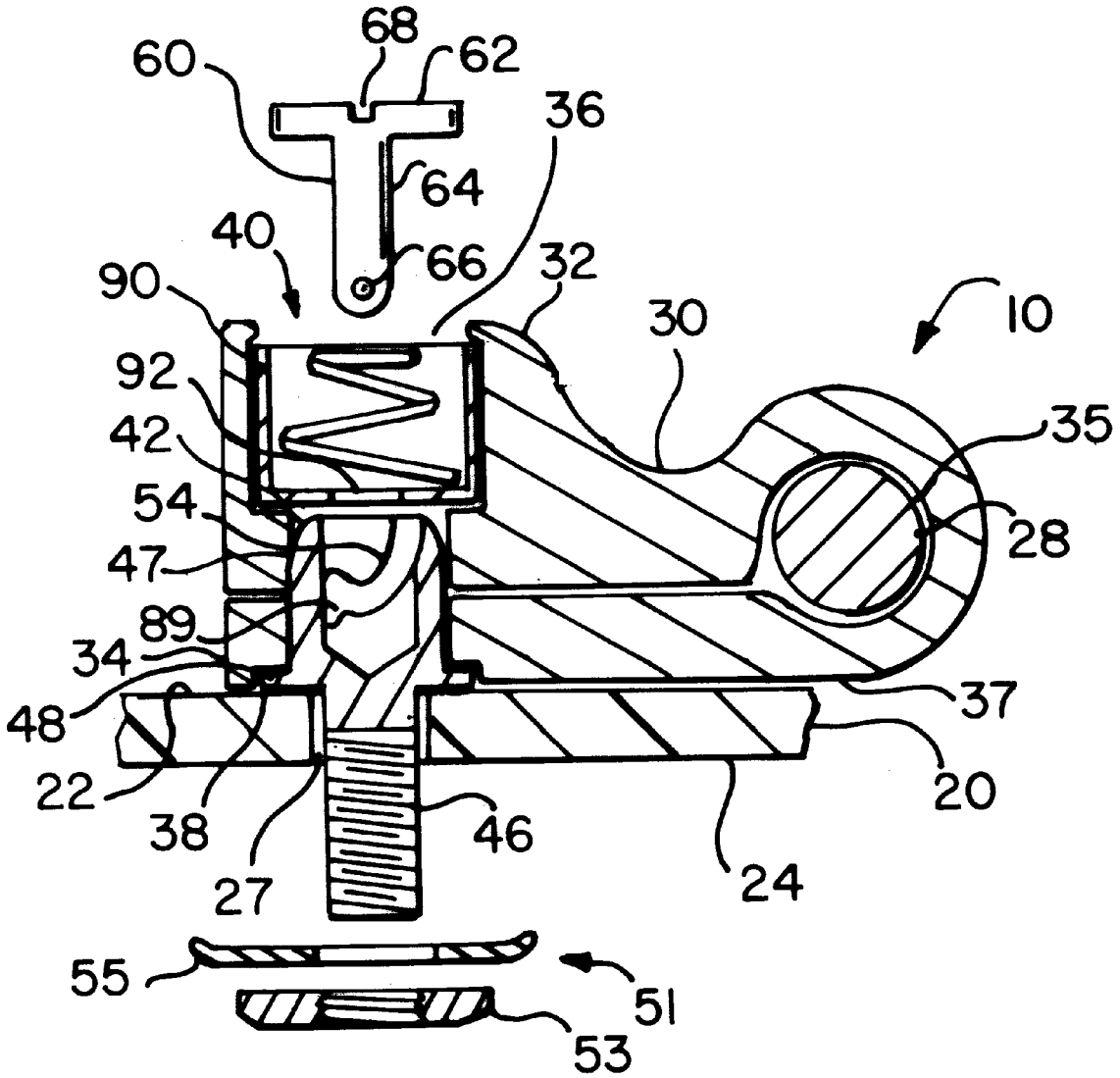
FIG. 2 is a cross sectional view, taken across the line 2—2 of FIG. 1, showing the clip secured to a helmet with a conventional nut and washer.
Figure 3:
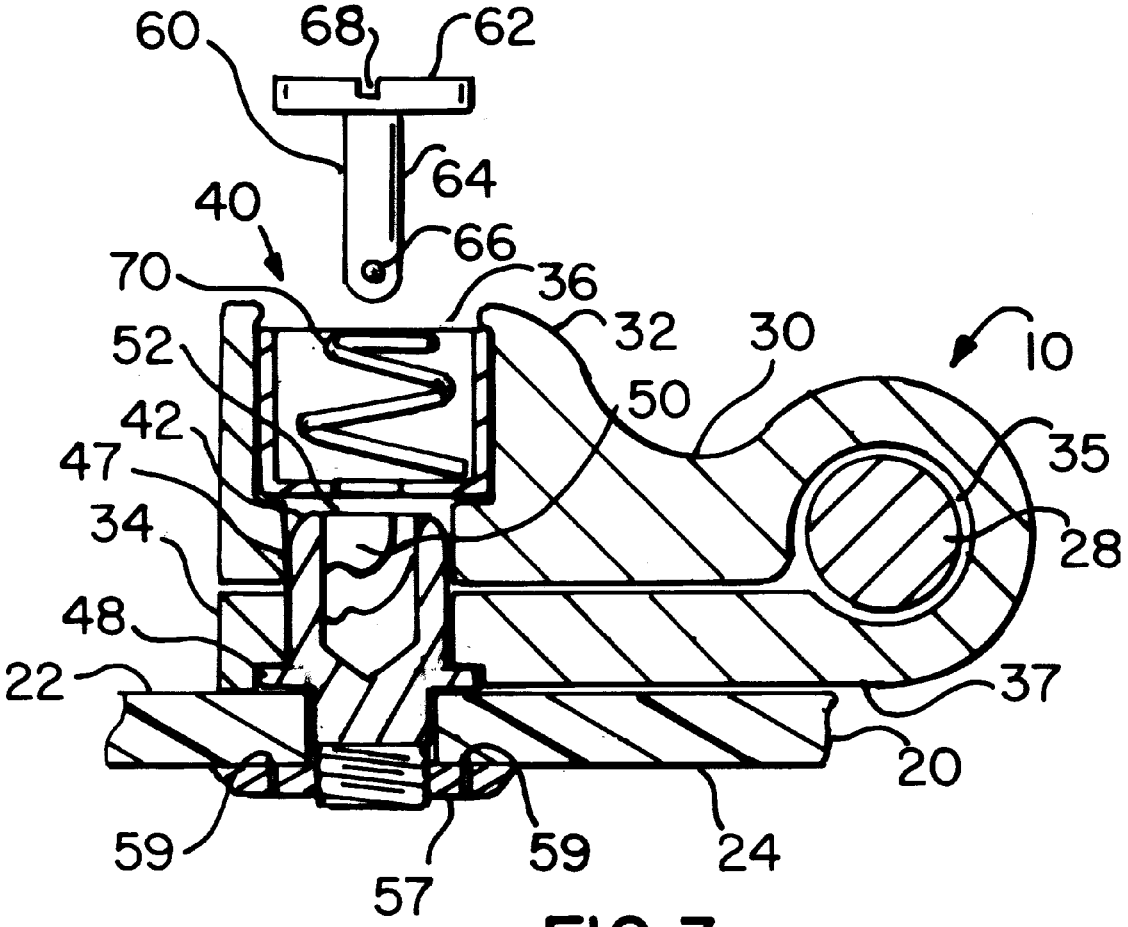
FIG. 3 is a cross sectional view, taken across the line 3—3 of FIG. 1, showing the clip secured to a helmet with a nut having engagement pins.

The locking member 51 may be a common locking nut 53 and washer 55. Referring now to FIG. 3, the locking member may, alternatively, comprise a nut 57 having one or more engagement pins 59 structured to embed into the inside surface of the helmet 20 upon tightening, thereby securing the nut 57 in place. In such an embodiment, the flange 48 may be hex shaped, square or otherwise configured so that, once the engagement pins 59 are embedded into the inside surface of the helmet 20, the female member 42 can be attached to or removed from the helmet 20 by simply grasping the flange 48 with the appropriate tool and rotating it until secured or loosened from the nut 57, as so desired. Referring now to FIG. 4, the locking member 51 may, alternatively, comprise a substantially flat, generally rectangular shaped wrench 80 having a first end 82 with an internally threaded bore 83 extending therethrough and a second generally handle-like end 84. The wrench shaped locking member 51 provides an alternative means for removing the face mask 26 from the helmet 20 in the event the primary locking mechanism discussed herein, i.e., the removal of the male member 60 from the female member 42, malfunctions such that the female portion 42 rotates with the male portion 60. In this scenario, the wrench-shaped locking member 51 will enable the user to, remove the female member 42, with the clip 30 and face mask 26 attached thereto, from the helmet 20, by rotating the male portion 60 and, attached female portion 42, in a direction opposite to that normally used to remove the male member 60 from the female member 42 until the elongate configuration of the handle-like end 84 catches on the inside surface of the helmet 20, causing the externally threaded lower portion 46 to unscrew from the wrench shaped locking member 51. An engagement pin 99 may also be provided to further grasp the inside surface of the helmet 20 and prevent the wrench-shaped locking member 51 from rotating.

The upper portion 47 of the female member 42 is structured to extend outward from the outside surface 22 of the helmet 20 and through the first mounting hole 36 in the inner leg 34 of the clip 30. The upper portion 47 includes a hole 50, accessible from its uppermost surface 52, structured to receive the leg 64 of the male member 60 therein. A generally J-shaped locking slot 54 is also accessible from the uppermost surface 52. The locking slot 54 is structured and disposed to receive the locking pin 66 therein as the leg 64 of the male member 60 is depressed and rotated into the hole 50. The locking slot 54 may be structured to fully engage the locking pin 66 upon ¼ or ½ turn of the male member 60. The locking slot 54 also includes a slight vertical recess 89 structured to entrap the locking pin 66 therein so as to prevent inadvertent disengagement of the male member 60 by merely depressing the male member 60 into the hole 50. A second locking pin and locking slot may be utilized, if desired, to further enhance the locking ability of the male 60 and female 42 members. Other alternative retention means known in the art may be utilized to retain the male member 60 to the female member 42.

In use, the lower portion 46 of the female member 42 is inserted through the mounting hole 27 in the helmet 20 and secured to the helmet 20 by the internally threaded locking member 51 disposed on the inside surface of the helmet 20. The clip 30, with the face mask 26 bar 28 secured within the slot 35, is then positioned over the female member 42 so that the flange 48 is seated within the recessed cavity 38 in the outer face 37 of the inner leg 34 of the clip 30 and the upper portion 47 extends into the first mounting hole 36. The male member 60 is then inserted into the first mounting hole 36 through the outer leg 32 until the leg 64 engages the hole 50 and the locking pin 66 engages the locking slot 54. The male member 60 is then depressed and rotated ¼ or ½ turn until the locking pin 66 is fully secured within the locking slot 54.

It can now be appreciated that the quick release mechanism of the present invention 10 provides the ability to detach the face mask 26 from the helmet by simply rotating the male members 60 ¼ or ½ turn and lifting the clips 30 off of the lower portions 46 of the female members 42. Such ease of removal is a clear improvement over the prior art.

The quick release mechanism 10 may also include an outwardly biased spring 70 positioned within the first mounting hole 36 between the male 60 and female 42 members. The spring 70 will function to force the male member 60 out of the first mounting hole 36 upon its disengagement with the female member 42, thereby further facilitating the face mask 26 removal process.

Additionally, a cup-like member 90 or washer (not shown) may be inserted into the first mounting hole 36 in the outer leg 32 of the clip 30 to provide further structural support. By inserting the locking pin 66 into the leg 64 after the male member 60 is inserted into the cup-like member 90 and the leg 64 is pushed through the hole 92 in the bottom of the cup-like member 90, the male member 60 and spring 70 will be retained to the cup-like member 90, thereby reducing the risk of losing the male member 60, and the spring 70, upon their removal from the female member 42.

While the invention has been described, disclosed, illustrated and shown in various terms of certain embodiments or modifications, which it has presumed in practice, the scope of the invention is not intended to be, nor should it be deemed to be, limited thereby and such other modifications or embodiments as may be suggested by the teachings herein are particularly reserved, especially as they fall within the breadth and scope of the claims here appended.

What is claimed is:

1. A helmet with a quick release face mask comprising:

a helmet having an outside surface and an opposite inside surface, said helmet being structured to be removably seated over a person's head so that said inside surface is in substantially direct contact with said person's head in generally overlying relation thereto;

a face mask extending across a facial opening of said helmet, said face mask having at least one generally rigid bar extending across said facial opening;

at least two generally U-shaped clips having an outer leg and an opposite inner leg, each of said clips being structured to removably secure one of said at least one bar of said face mask between said outer and inner legs; and a coupling mechanism structured to releasably secure said clips to said helmet, said coupling mechanism having a female member structured to be secured to said helmet and a male member structured for removable insertion into a first mounting hole extending through said outer and inner legs of said clips and mating engagement with said female member, whereby disengaging said male member from said female member releases said clip from said helmet, said female member including a lower portion structured for insertion through a second mounting hole in said helmet and mating engagement with a locking member disposed on said inside surface of said helmet, an opposite upper portion structured for mating engagement with said male member and an outwardly extending flange disposed between said lower and upper portions and structured to be removably seated between said inner leg of said clip and said outside surface of said helmet.

2. A helmet with a quick release face mask as recited in claim 1 wherein said flange is seated within a recessed cavity surrounding said hole in said inner leg.

3. A helmet with a quick release face mask as recited in claim 1 wherein said male member includes a generally T-shaped cross section having a generally flat head and a generally tubular leg extending out from said head in perpendicular relation thereto, said leg including at least one locking pin extending outward in perpendicular relation thereto, said leg and said at least one locking pin being structured for removable insertion into a corresponding shaped opening and locking slot, respectively, in said upper portion of said female member and rotation from a first unlocked position, wherein said male member is disengaged from said female member, to a second locked position, wherein said at least one locking pin is secured within said locking slot and said male member is matingly engaged within said female member.

4. A helmet with a quick release face mask as recited in claim 3 wherein said head includes a generally longitudinally disposed slot.

5. A helmet with a quick release face mask as recited in claim 1 further including an outwardly biased spring positioned within said first mounting hole between said male and female members.

6. A helmet with a quick release face mask as recited in claim 1 wherein said locking member comprises a substantially flat, generally rectangular shaped wrench having an internally threaded bore extending therethrough.

7. A helmet with a quick release face mask comprising:

a helmet having an outside surface and an opposite inside surface, said helmet being structured to be removably seated over a person's head so that said inside surface is in substantially direct contact with said person's head in generally overlying relation thereto;

a face mask extending across a facial opening of said helmet, said face mask having at least one generally rigid bar extending across said facial opening;

at least two generally U-shaped clips having an outer leg and an opposite inner leg, each of said clips being structured to removably secure one of said at least one bar of said face mask between said outer and inner legs; and a coupling mechanism structured to releasably secure said clips to said helmet, said coupling mechanism having a female member, structured to be secured to said helmet and a male member structured for removable insertion into a first mounting hole extending through said outer and inner legs of said clips and mating engagement with said female member, said female member having a lower, partially externally threaded portion structured for insertion through a second mounting hole in said helmet and mating engagement with an internally threaded locking member disposed on said inside surface of said helmet, an opposite upper portion structured for mating engagement with said male member, and an outwardly extending flange disposed between said lower and upper portions and structured to be removably seated between said inner leg of said clip and said outside surface of said helmet, whereby disengaging said male member from said female member releases said clip from said helmet.

8. A helmet with a quick release face mask as recited in claim 7 wherein said flange is seated within a recessed cavity surrounding said hole in said inner leg.

9. A helmet with a quick release face mask as recited in claim 7 wherein said male member includes a generally T-shaped cross section having a generally flat head and a generally tubular leg extending out from said head in perpendicular relation thereto, said leg including at least one locking pin extending outward in perpendicular relation thereto, said leg and said at least one locking pin being structured for removable insertion into a corresponding shaped opening and locking slot, respectively, in said upper portion of said female member and rotation from a first unlocked position, wherein said male member is disengaged from said female member, to a second locked position, wherein said at least one locking pin is secured within said locking slot and said male member is matingly engaged within said female member.

10. A helmet with a quick release face mask as recited in claim 9 wherein said head includes a generally longitudinally disposed slot.

11. A helmet with a quick release face mask as recited in claim 7 further including an outwardly biased spring positioned within said first mounting hole between said male and female members.

12. A helmet with a quick release face mask as recited in claim 7 wherein said locking member comprises a substantially flat, generally rectangular shaped wrench having an internally threaded bore extending therethrough.

13. A quick release mechanism for use with a helmet having an outside surface, an opposite inside surface and a face mask with at least one generally rigid bar extending across a facial opening of the helmet, the quick release mechanism comprising:

at least two generally U-shaped clips having an outer leg and an opposite inner leg, each of said clips being structured to removably secure one of the at least one bar of the face mask between said outer and inner legs; and a coupling mechanism structured to releasably secure said clips to the helmet, said coupling mechanism having a female member structured to be secured to the helmet and a male member structured for removable insertion into a first mounting hole extending through said outer and inner legs of said clips and mating engagement with said female member, whereby disengaging said male member from said female member releases said clip from the helmet, said female member including a lower threaded portion structured for insertion through a second mounting hole in the helmet and mating engagement with a locking member disposed on the inside surface of the helmet.

14. A helmet with a quick release face mask as recited in claim 13 wherein said female member further includes an opposite upper portion structured for mating engagement with said male member and an outwardly extending flange disposed between said lower and upper portions and structured to be removably seated between said inner leg of said clip and the outside surface of the helmet.

15. A helmet with a quick release face mask as recited in claim 14 wherein said flange is seated within a recessed cavity surrounding said hole in said inner leg.

16. A helmet with a quick release face mask as recited in claim 14 wherein said male member includes a generally T-shaped cross section having a generally flat head and a generally tubular leg extending out from said head in perpendicular relation thereto, said leg including at least one locking pin extending outward in perpendicular relation thereto, said leg and said at least one locking pin being structured for removable insertion into a corresponding shaped opening and locking slot, respectively, in said upper portion of said female member and rotation from a first unlocked position, wherein said male member is disengaged from said female member, to a second locked position, wherein said at least one locking pin is secured within said locking slot and said male member is matingly engaged within said female member.

17. A helmet with a quick release face mask as recited in claim 16 wherein said head includes a generally longitudinally disposed slot.

18. A helmet with a quick release face mask as recited in claim 13 further including an outwardly biased spring positioned within said first mounting hole between said male and female members.

19. A helmet with a quick release face mask as recited in claim 14 wherein said locking member comprises a substantially flat, generally rectangular shaped wrench having an internally threaded bore extending therethrough.

* * * * *